United States Patent [19]

Altherr

[11] 4,258,628

[45] Mar. 31, 1981

[54] ARTICULATED RAILWAY COUPLING

[75] Inventor: Russell G. Altherr, Munster, Ind.

[73] Assignee: AMSTED Industries Incorporated, Chicago, Ill.

[21] Appl. No.: 47,272

[22] Filed: Jun. 11, 1979

[51] Int. Cl.[3] ..... B61D 3/10; B61F 3/12; B61F 5/18; B61G 5/02

[52] U.S. Cl. ..... 105/4 R; 105/199 C; 213/75 R

[58] Field of Search ..... 105/4 R, 189, 189 C, 105/199 C; 213/72, 75 R; 308/137

[56] References Cited

U.S. PATENT DOCUMENTS

| | | | |
|---|---|---|---|
| 2,212,843 | 8/1940 | Metzger | 213/72 X |
| 3,216,370 | 11/1965 | Kulicke | 105/189 X |
| 3,396,673 | 8/1968 | Livelsberger et al. | 105/189 X |
| 3,646,604 | 2/1972 | Tack et al. | 105/4 R |
| 3,716,146 | 2/1973 | Altherr | 213/75 R |

*Primary Examiner*—Howard Beltran

*Attorney, Agent, or Firm*—John L. Schmitt; Fred P. Kostka; Edward J. Brosius

[57] ABSTRACT

Articulating devices may be used to combine railroad cars into a semi-permanent unit. Each device includes a male and female connecting member having ends attached respectively to adjacent ends of the railroad car bodies forming the unit. A pin disposed in aligned apertures formed in the outer end of each member forms a joint therebetween. To allow for vertical and horizontal movements between the members during operation of the unit, the pin aperture in the male member is larger than the pin and has a rear surface portion providing a substantial contact area with the pin. To maintain the pin aperture and pin in a controlled slack relationship, the male member is urged forward by a follower which is carried within the female member and engages an end surface of the male member. The position of the follower in turn is regulated by a wedge element which engages a pair of resilient elements carried by the follower.

2 Claims, 6 Drawing Figures

F
10
12
14
16
17
18
20
22
24
26
28
30
32
34
36
38
40
42
44
45
45a
48
54
56
70
72
84
82
90
92
124
132
136
138
139
146
148
150
3

ARTICULATED RAILWAY COUPLING

BACKGROUND OF THE INVENTION

1. Field of the Invention

This invention relates to coupling means for joining two railroad cars and more particularly to an articulating device whereby a plurality of railroad cars may be joined to form a semi-permanent unit.

2. Description of the Prior Art

Use of standard AAR (Association of American Railroads) couplers to join railroad cars is well known. Such couplers are so designed to facilitate the connecting or disconnecting of individual railroad cars allowing the cars to be readily combined to make a train or individually separated for loading or unloading, for example.

In recent times, the railroad industry has found that the joining of several cars to form a semi-permanent unit is advantageous. For example, railroad cars particularly adapted for piggyback service have been so joined into such units and been referred to as a "10-pack." Such a unit does not need the use of the standard coupler except between units since each unit is only periodically broken to allow maintenance on an individual component. In this arrangement, therefore, one standard railroad car truck may be used to support ends of adjacent car bodies.

SUMMARY OF THE INVENTION

An articulating device of this invention includes a male connecting member attached on a rear of a first railroad car body and a female member connected to a front of a second railroad car body. The female member in turn is carried in a centerplate of a bolster of a railroad car truck in a known manner. An outer end of the male member is disposed in a cavity formed in the female member. Both members are joined by a vertically positioned pin which is disposed in aligning apertures formed in each member. The pin aperture in the male member is somewhat larger than the pin. A rear surface portion of the male pin aperture has a horizontal concave configuration and vertical convex configuration allowing both members to move horizontally and vertically with respect to each other while at the same time providing a substantial area of contact between the rear surface portion of the pin aperture and the pin.

An end surface of the male connecting member has a convex configuration which abuts with a complementary concave surface formed on a front face of a follower carried within a rear portion of the cavity. On a rear face of the follower is a pair of vertical slots each containing a resilient element which protrudes outwardly from the follower. The resilient elements are engaged by a vertically disposed wedge element which urges the follower and male connecting member forward so as to maintain the rear surface portion of the male connecting pin aperture in contact with the pin.

There are several advantages of the articulating device of this invention over other known devices.

First, known articulating devices commonly include a pin bearing block which interfaces between the male connecting member and the pin. In this invention, this element has been eliminated. This elimination not only increases the cross-sectional thickness of an end wall of the male connecting member and thus its strength, but also reduces the overall cost of the device by not requiring this precision component. Additionally, when a known articulating device with a pin bearing block is placed in buff, the pin bearing block can become mislocated and subsequently be damaged when a draft force is applied to the device.

Secondly, the pin and the rear surface portion of the male member pin aperture are maintained in substantially continuous contact. Thus, when a draft force is applied to this articulating device, the magnitude of impact forces between the pin and the male connector end wall is minimized. The entire unit of railroad cars thus moves forward as a unit.

Thirdly, the rear surface of the male connector end wall and the follower are also maintained in continuous contact. Thus, when a buff force is applied to this articulating device, the magnitude of impact forces between the follower and the male connecting member is also minimized. Additionally, the resilient elements help cushion contact between the follower and the wedge element.

Lastly, any slack which develops because of wear of the pin, the male connecting member pin aperture, the rear surface of the male connecting member and front face of the follower, is automatically eliminated. As these various surfaces wear, the frictional force existing between the resilient elements and the wedge element decreases sufficiently to allow the wedge element to drop to a lower position so as to move the follower and the male connecting member forward. Thus, these components may remain in a controlled slack relationship during the life of the device.

Further, these components can be combined to provide a controlled slack relationship in a standard coupling system where an inner end of a shank of the coupler head interacts with a yoke through a similar follower-resilient elements-wedge element relationship. Thus, several of the advantages provided to the existing articulating devices can likewise be utilized in a standard coupling system arrangement.

DESCRIPTION OF THE PREFERRED EMBODIMENT

Figures 1, 2:
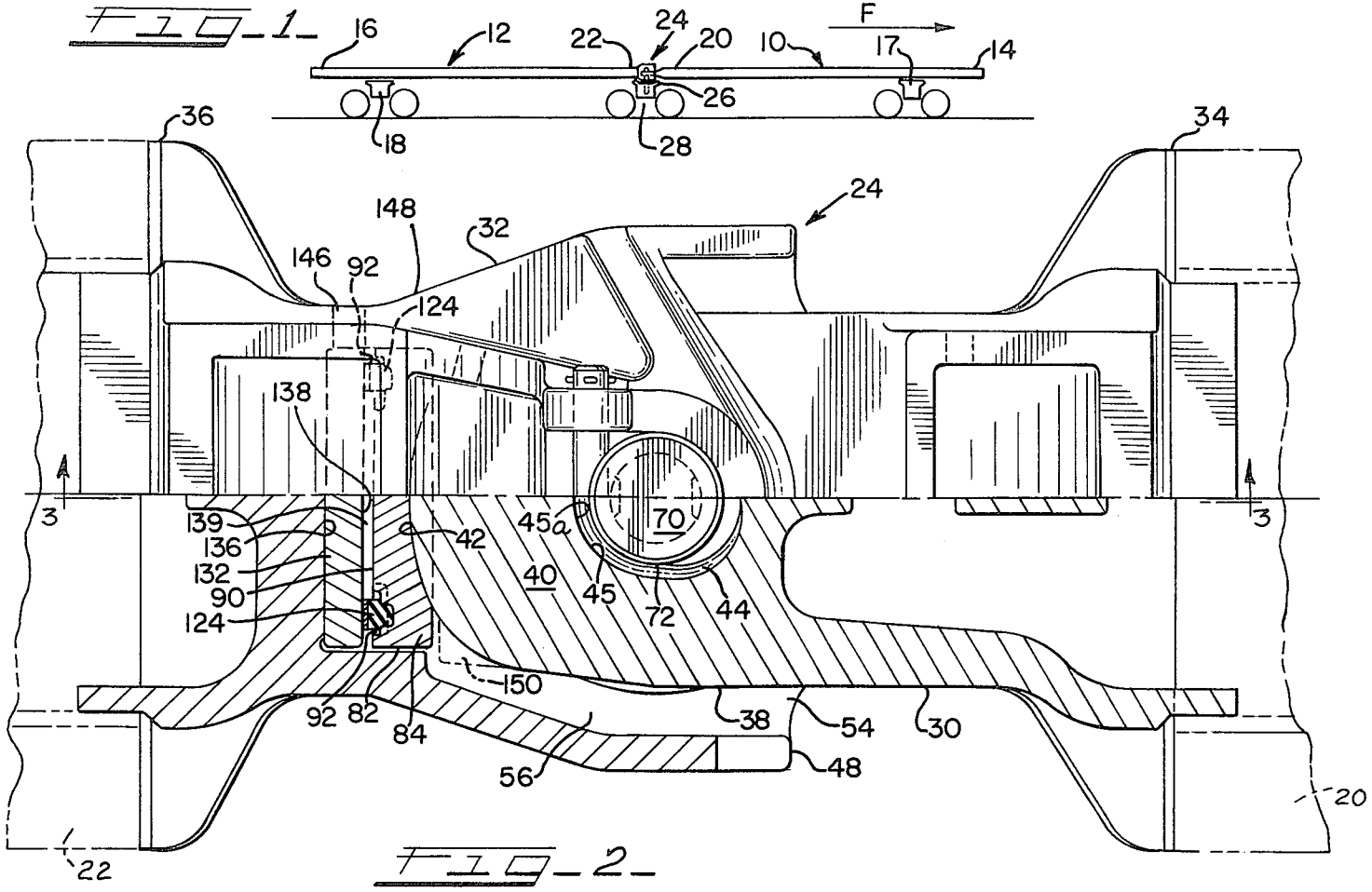
FIG. 1 is a simplified view of two railroad cars being connected by an articulating device of this invention and supported by a single truck therebelow to form a unit.
FIG. 2 is a detailed plan view in partial section of the articulating device of FIG. 1.

As best understood by viewing FIG. 1, a first and a second railroad car body 10, 12 each has its outer or unattached ends 14, 16 supported respectively by conventional car trucks 17, 18 in a known manner. Inner ends 20, 22 of the car bodies 10, 12 are joined by an articulating device 24 of this invention which in turn is carried on a bolster 26 of a single car truck 28. It should be understood that more than two railroad car bodies may be so joined to form a unit. In this example, the unit simply comprises the first and second car bodies 10, 12 joined by the articulating device 24 and carried on the railroad car trucks 17, 18 and 28.

Figure 3:
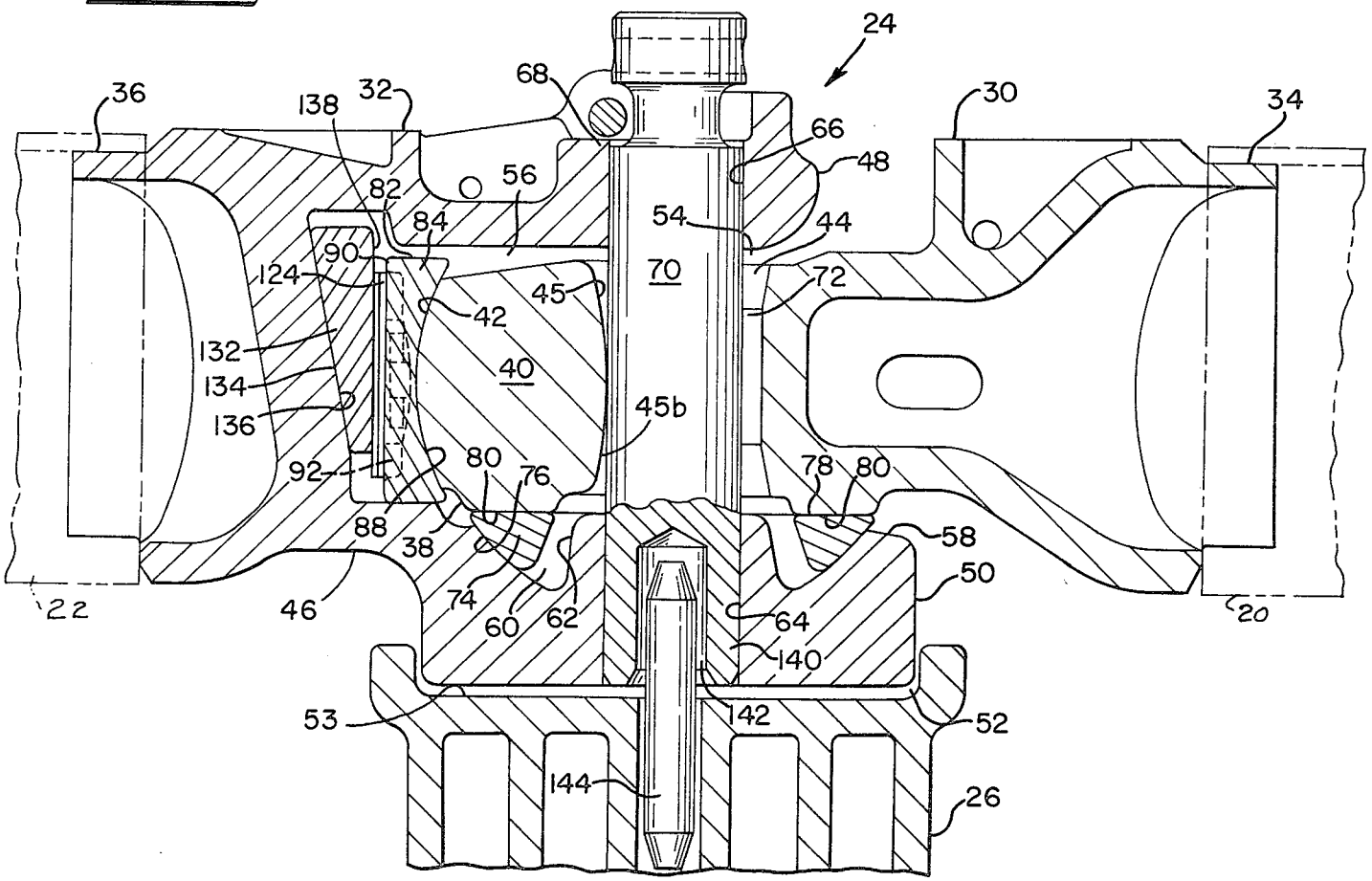
FIG. 3 is a cross-sectional elevational view of the device as generally seen along the line 3—3 of FIG. 2.

As further understood by viewing FIGS. 2 and 3, the articulating device 24 includes a male connecting member 30 and a female connecting member 32. The device 24 is directional in that a front end 34 of the male connecting member 30 is attached in a fixed manner to the rear or inner end 20 of the car body 12 when the cars 10, 12 are traveling in a forward direction as depicted by an arrow F in FIG. 1. Likewise, a rear end 36 of the female connecting member 32 is attached in a fixed manner to the front or inner end 22 of the second car body 12.

An outer or rear end 38 of the male connecting member 30 is formed having an end wall 40 defined in part by convex radiused end surface 42. The rear end 38 further includes a vertical pin aperture 44. As shown in FIGS. 2 and 3, a rear portion 45 of the pin aperture 44 is so formed to have a horizontally concave configuration 45*a* and a vertical convex configuration 45*b*.

On a bottom 46 of an outer end 48 of the female connecting member 32 is an annular boss 50 forming the inserting portion of a centerplate joint 52. A receiving portion 53 of the centerplate joint 52 is formed as part of the truck bolster 26 and receives therein the boss 50.

The female connecting member 32 is further defined by a front opening 54 leading to an inner cavity 56. In a bottom surface 58 of the cavity 56 is a disk-shaped annular groove 60 positioned about a circular hub 62. A vertical circular aperture 64 extends through the hub 62 and the boss 50. The aperture 64 aligns with a second vertical circular aperture 66 extending through a top portion 68 of the outer end 48 of the female connecting member 32. A pin 70 extends through the apertures 64, 66 in the female connecting member 32 and through the pin aperture 44 in the male connecting member forming a movable joint 72 between the members 30, 32.

Movement between the connecting members 30, 32 is regulated in part by a ring 74 having an outer radiused surface 76 complementarily formed for movement within the annular groove 60. A top surface 78 of the ring 74 engages a flat bottom surface 80 formed about the pin aperture 44.

Movement between the connecting members 30, 32 is further regulated by a follower 82 having a rectangular-shaped body 84. On a front face 86 of the follower 82 is a radiused concave portion 88 receiving in a complementary manner the end surface 42 of the male connecting member end wall 40.

Figure 4:
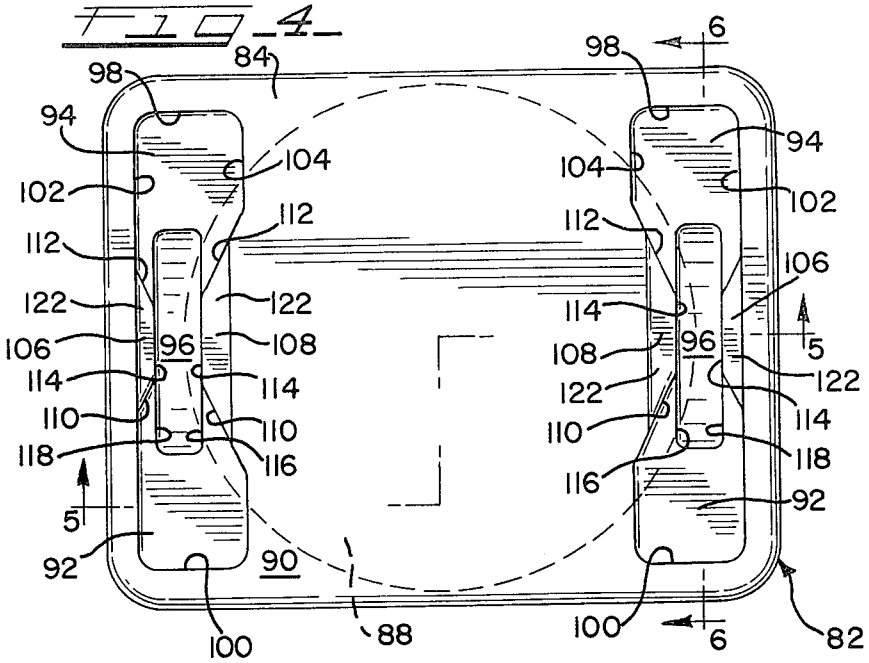
FIG. 4 is an elevational view of a rear side of a follower of the device of FIG. 2.
Figure 5:
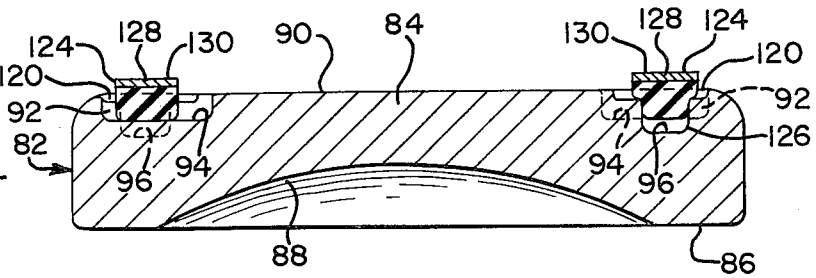
FIG. 5 is a cross-sectional view of the follower of FIG. 4 as seen generally along the line 5—5 in FIG. 4 and also shows a resilient element positioned within slots formed in the follower.
Figure 6:
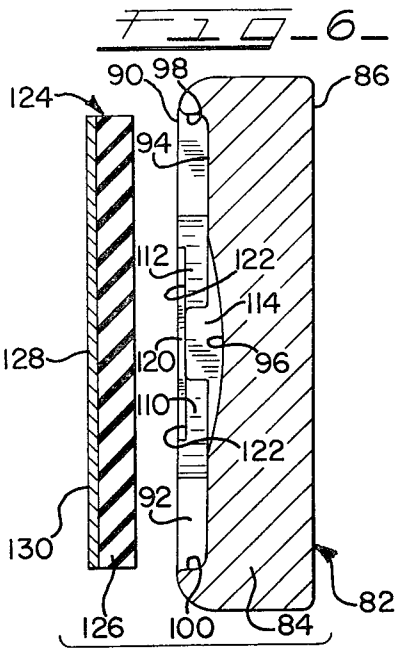
FIG. 6 is a further cross-sectional view of the follower of FIG. 4 as seen generally along the line 6—6 of FIG. 4 with the resilient element disassembled from its respective slot.

As best understood by viewing FIGS. 4, 5 and 6, on a rear face 90 of the follower 82 is a pair of spaced vertical slots 92. In an inner surface 94 of each slot 92 is a disk-shaped groove 96 positioned proximately equidistant between a top and bottom end wall 98, 100 and somewhat offset from a vertical center line of the slot 92 toward an outer sidewall 102 of each slot 92.

Projecting inwardly from the outer sidewall 102 and an inner sidewall 104 is a frustum-shaped projection 106, 108. Inclined sides 110, 112 of each projection 106, 108 converge toward the groove 96 and terminate at an inner face 114. The inner faces 114 align with vertical sides 116, 118 of the slots 92 and are inwardly opposing. The projections 106, 108 are less than full width and thus inwardly offset to provide a recess 120 between an outer surface 122 of each projection 106, 108 and the rear face 90 of the follower 82.

Compressively disposed between the two projections 106, 108 in each of the slots 92 is an elongated resilient element 124 which is held between the inner faces 114 of the projections 106, 108. Each resilient element 124 includes an inner elastomeric body portion 126 and an outer metal strip 128 affixed thereto. The outer metal strip 128 may be wider than the body portion to facilitate bonding of these two dissimilar materials.

A thickness of each resilient element 124 is such that in a neutral or uncompressed state, an outer surface 130 of each metal strip 128 projects beyond the rear face 90 of the follower 82 by proximately 3/16 of an inch.

Interfacing with an upper and middle portion of the metal strip outer surface 130 of each resilient element 124 is a wedge element 132. The wedge element 132 further includes an inclined rear face 134 which abuts a complementarily formed inclined rear surface 136 of the cavity 56 so as to maintain a front face 138 of the wedge element 132 substantially vertical and located away from rear face 90 of the follower 82 to provide a clearance space 139. The overall height of the wedge element 132 is proximately 80 percent of a height of the cavity 56 adjacent to the rear surface 136. It should be understood that the resilient elements 124 could be carried by the wedge element 132 or even the rear surface 136 of the cavity 56 so as to provide the necessary clearance 139.

As was noted earlier, the use of the follower 82 can also be incorporated in a standard railroad coupler system wherein an inner end of a shank portion of the coupler head engages the concave radius portion 88 of the follower 82. The follower 82 would be formed with slots 92 to hold resilient elements 124. The resilient elements 124 in turn interact with the wedge element 132 which in turn would engage with a yoke of the coupler system. This arrangement would provide the standard coupler system with many of the advantages of having the controlled slack means described in detail herein.

During initial assembly of the connecting members 30, 32, the outer end 38 of the male member 30 is placed in the cavity 56 of the female member 32 such that the pin 70 may be inserted into the top aperture 66 through the pin aperture 44 and into the bottom aperture 64. A lower end 140 of the pin 70 is formed having a cylindrical cutout 142 to accommodate an upper end of a center pin 144, the lower end of which is carried by the receiving centerplate portion 53 on the bolster 26.

Side access holes 146, shown in FIG. 2, are provided in sidewalls 148 of the female connecting member 32 allowing a rod or other such device to be inserted into the cavity 56 and maintain the wedge element 132 in a raised position. With the pin 70 inserted as noted above, the rod is withdrawn allowing the wedge element 132 to drop and force the follower 82 forward to reduce any slack existing between the concave radiused portion 88 of the follower 82 and the end surface 42 of the male connecting member 30. The wedge element 132 will force the follower 82 further forward to eliminate any slack when a draft force is first applied to the male connecting member 30 if any slack exists between the rear portion 45 of the pin aperture 44 and the pin 70. After this first initial application of a draft force, the female connecting member 32, the wedge element 132, the follower 82, the male connecting member 30 and the pin 70 are placed in a controlled slack relationship.

Assuming this controlled slack relationship between the various elements of the connecting members 30, 32 noted above, each member 30, 32 is free to rotate with respect to the other member as must occur under normal operation of the unit.

For example, as the cars 10, 12 proceed about a curved section of track on which the unit is traveling, there may be both vertical and horizontal rotational movement between the connecting members 30, 32. When such vertical movement occurs, the convex vertical rear surface portion **45*b* of the pin aperture 44 rolls on the pin 70 so that the area of contact between the pin 70 and the pin aperture 44 is displaced from a point aligning with a horizontal axis of the device 24. Note that the contour of the convex vertical surface portion 45*b* is such that the area of contact or bearing area with the pin 70** although reduced remains sufficient to maintain stress produced within tolerable limits.

This rolling action over the pin 70 forces the follower 82 rearward because the configuration of the end surface 42 on the male connecting member 30 is not the same as the convex vertical surface portion **45*b* of the pin aperture 44. The rearward movement of the follower 82 is accomplished by a compression of the resilient members 124 to increase the occupancy of each slot 92 of the respective resilient member 124 and consequently a reduction in the clearance space 139. The configuration of each slot 92 has been so designed to accommodate this compression of the elastomeric body portion 126 of the resilient element 124 and further allow the resilient element 124 to return to its precompressed configuration when the connecting members 30, 32 return to horizontal alignment. Note that under most extreme conditions, the outer surface 130 of the metal strip 128 of the resilient member 124 may be flush with the rear face 90 of the follower 82 with the metal strip 128 received by the recesses 120 of the slot 92. Under these circumstances, the clearance space 139** is nonexistent.

During the vertical rotational movement between the connecting members 30, 32, the bottom surface 80 of the male connecting member end wall 40 slides over the top surface 78 of the ring 74 as the ring 74 is rotated to a nonaligning position within the annular groove 60.

During horizontal rotational movements between the connecting members 30, 32, the follower 82 is only slightly depressed rearward since the concave horizontal rear surface portion **45*a* of the pin aperture 44 is substantially circular and formed from the same axis point as the concave end surface 48 of the male connecting member end wall 40**.

When the male connecting member 30 is subjected to a buffing force so as to push the unit in a backward direction, i.e. a direction opposite that depicted by the arrow F, the male connecting member 30 and the follower 82 move rearward to fully compress the resilient elements 124. The buffing force is then transferred from the follower 82 to the wedge element 132 and in turn to the female connecting member 32.

As shown in part in FIG. 2, the end wall 42 of the male connecting member 30 may be alternatively formed with a pair of spaced abutment shoulders positioned on each side of the end surface 42. One such shoulder 150 is shown by phantom lines. Such shoulders improve the translation of a buffing force when the connecting members 30, 32 have rotated horizontally to a misaligning position. When the male connecting member 30 rotates clockwise, for example, the shoulder 150 contacts the follower 82 and moves it rearward. This rearward movement compresses at least one of the resilient elements 124 in the same manner as described earlier.

As the various surfaces in contact wear, for example, the rear surface portion 45 of the pin aperture 44 and the pin 70, and the male connecting member end surface 42 and the follower concave portion 88, this wear does not alter the controlled slack relationship between the various parts. Any additional slack which is created because of wear, is automatically eliminated by a change of position of the wedge element 132. Under the influence of gravity, the wedge element 132 adjusts to a lower position within the cavity 56 so as to move the follower 82 forward and eliminate such excess slack.

While various modifications may be suggested by those versed in the art, it should be understood that I wish to embody within the scope of the patent warranted hereon all such modifications as reasonably and properly come within the scope of my contribution to the art.

What is claimed is:

1. In an articulating device for joining adjacent first and second railroad car bodies, said device comprising a male connecting member attached to a rear of said first car body and a female connecting member attached to a front of said second car body, said female member having an inner cavity for disposition of an outer end of said male connecting member, said male connecting member outer end having a convex radiused end surface for complementary engagement with a concaved radiused portion of a follower in operative contact with a wedge element disposed between said follower and a sloped end surface of said female connecting member cavity, said female and male connecting members joinable by a pin located in aligned apertures in said female member and through a pin aperture in said male member, the improvement in said device comprising, said male connecting member radiused end surface and a rear portion of said pin aperture defining therebetween a solid, continuous end wall with said rear portion of said pin aperture having a vertical convex configuration forming a substantial contact area with said pin, and resilient means carried in part in slot means formed in a rear face of said follower to selectively receive said resilient means in a compressed state, said resilient means in a natural state projecting outwardly from said follower to engage said wedge element and maintain said follower and said wedge element in a spaced relationship, said resilient means being compressible within said slot means upon a buffing force being applied to said members so as to alter said spaced relationship between said follower and said wedge element, and said resilient means being compressible within said slot means upon said members being horizontally misaligned in response to pitching motions between said members with said substantial area of contact between said male member pin aperture and said pin shifting vertically in response to said pitching motion.

2. In an articulating device for joining railroad car bodies, said device having a male connecting member connected to a rear end portion of a first car body and a female connecting member connected to a front end portion of a second car body, said first and second car bodies being joinable by said device into a unit by a pin insertable through outer end portions of said connecting members with said railroad car body end portions supportable from a single railroad car truck carrying said articulating device, the improvement therein comprising, a pin aperture formed in an outer end of said male member to receive said pin, a rear surface portion of said aperture having a horizontal concave configuration and a vertical convex configuration providing a substantial area of contact with said pin, a follower disposed in a cavity formed in said female member, said follower having a concave front face portion to complementarily receive a convex end surface formed on said male connecting member outer end, and resilient means carried by a rear face of said follower, said resilient means having an outer surface extending beyond said follower rear face in a natural state, said resilient means having a pair of spaced elongated resilient elements each having a metal strip forming said outer surface and an elastomeric body partially disposed respectively in spaced slots formed on said rear surface of said follower, wedging means movably disposed between said outer surface of said follower resilient means and a rear surface of said cavity to form a selective space between said follower and said wedging means, and each said slot being vertically orientated and containing a disk-shaped groove centered vertically within an inner surface of said slot and offset laterally toward an outer sidewall of said slot, and a projection carried one each by sidewalls of said slots, each projection extending inwardly toward said groove and having an inner face terminating to proximately align with vertical sides of said groove respectively, each said projection being inwardly offset to form a recess below said rear face of said follower, said elastomeric body of said resilient means being compressively held between said projections with said body compressing into said groove and said metal strip received in said recesses upon said resilient means being sufficiently compressed, wherein said wedging means may drop to a lower vertical position so as to maintain said follower in contact with said end surface of said male connecting member and said male connecting member pin aperture in contact with said pin as said follower, said male member, and said pin wear from use.

* * * * *